US007080888B2

(12) United States Patent
Hach

(10) Patent No.: US 7,080,888 B2
(45) Date of Patent: Jul. 25, 2006

(54) DUAL NOZZLE HYDRO-DEMOLITION SYSTEM

(75) Inventor: William W. Hach, Baltimore, MD (US)

(73) Assignee: Ash Equipment Company, Inc., Baltimore, MD (US)

( * ) Notice: Subject to any disclaimer, the term of this patent is extended or adjusted under 35 U.S.C. 154(b) by 32 days.

(21) Appl. No.: 10/378,130

(22) Filed: Mar. 4, 2003

(65) Prior Publication Data

US 2004/0182960 A1 Sep. 23, 2004

(51) Int. Cl.
*E21C 45/04* (2006.01)

(52) U.S. Cl. ..... 299/17; 299/30

(58) Field of Classification Search ..... 299/17, 299/30

See application file for complete search history.

(56) References Cited

U.S. PATENT DOCUMENTS 2,060,409 A * 11/1936 Ball ..... 137/1
3,726,481 A * 4/1973 Foster et al. ..... 239/754
4,081,200 A * 3/1978 Cheung ..... 299/17
4,619,551 A * 10/1986 Juan et al. ..... 404/90
4,854,770 A * 8/1989 Puchala et al. ..... 404/75
5,022,927 A * 6/1991 Seidel ..... 134/34
6,049,580 A * 4/2000 Bodin et al. ..... 376/316
6,224,162 B1 * 5/2001 MacNeil et al. ..... 299/17
2002/0124700 A1 * 9/2002 Aulson ..... 83/53

OTHER PUBLICATIONS

Snow, Dennis "Plant Engineer's Reference Book" 2002. pp. 20/15,20/16, 20/19.*
Anonymous, "Fluid Power", 1970, US Government Printing Office, pp. 84 and 85.*

* cited by examiner

*Primary Examiner*—John Kreck
(74) *Attorney, Agent, or Firm*—H. Jay Spiegel

(57) ABSTRACT

A dual nozzle hydro-demolition system is mounted on a robot vehicle having a tower, with the robot vehicle and tower permitting the device to be positioned in any desired location on a vertical wall surface. The robot vehicle includes a plurality of tires and a motive power system allowing it to be moved to a desired location. Bearing pads are mounted on jacks allowing the tires of the robot vehicle to be elevated slightly off the ground to preclude undesired movements. A carriage is slidably mounted on a beam and carries dual nozzles, each of which is connected to a supply of high pressure water via a heavy duty hose. The nozzles are rotated using a hydraulic motor. A coupling is provided within the flow circuit from the source of water to the nozzle allowing a conduit adjacent the nozzle to rotate with respect to a conduit receiving water from the source thereof, so that each nozzle can be rotated without any water leakage.

9 Claims, 6 Drawing Sheets

DUAL NOZZLE HYDRO-DEMOLITION SYSTEM

BACKGROUND OF THE INVENTION

The present invention relates to a dual nozzle hydro-demolition system. In the prior art, it is known to demolish concrete using a single nozzle system in which a nozzle is reciprocated along a beam while it is also caused to rotate so that high pressure water can be used to pulverize concrete in a wall or floor or road surface. Systems that are known in the prior art are limited in that flow capacity and pressure are limited, thereby limiting the depth of concrete that may be pulverized. Furthermore, such systems are limited in that they are only able to be employed at or near ground level.

Further, due to limitations on flow through such devices, speed of pulverization is also limited. Thus, for example, to pulverize a certain thickness of concrete, several passes of the rotating nozzle back and forth are necessary. If the capacity for water flow of the device could be increased, the number of passes back and forth necessary to complete the pulverization would be drastically reduced along with the time period during which such pulverization takes place.

It is with these needs in mind that the present invention was developed.

SUMMARY OF THE INVENTION

The present invention relates to a dual nozzle hydro-demolition system. The present invention includes the following interrelated objects, aspects and features:

(1) In a first aspect, the inventive device is mounted on a robot vehicle having a tower, with the robot vehicle and tower permitting the inventive device to be positioned in any desired location on a vertical wall surface. The tower allows reciprocation of a frame carrying the nozzles up to the height limit thereof to facilitate pulverization of concrete at elevations several stories off the ground.

(2) The robot vehicle includes, in one example, a plurality of tires and a motive power system allowing it to be moved to a desired location. Of course, if desired, the tires can be provided without motorization so that the robot vehicle can be towed and positioned in a desired location and orientation.

(3) Bearing pads are provided on the robot vehicle, with the bearing pads being mounted on jacks allowing the tires of the robot vehicle to be elevated slightly off the ground to preclude undesired movements thereof. Tie-downs may also be provided to facilitate firm securement of the robot vehicle in a desired fixed location, taking into account the large force generated by high pressure water.

(4) The heart of the device consists of a carriage slidably mounted on a beam mounted on the frame and reciprocable back and forth along the beam through the use of a sprocket, chain and hydraulic motor drive system. The motor is rotated in one direction or another through the use of a unidirectional pump that is electrically activated and the direction of rotation of the motor is reversible through operation of a reversing valve. Switches mounted on the beam are tripped when the carriage reciprocates to them, with the switches causing the tripping of an electrical circuit which moves the valve to a position causing the direction of rotation of the motor to reverse, to thereby reverse the direction of movement of the carriage along the beam. The position of the switches may suitably be adjusted to adjust the extent of travel of the carriage on the beam.

(5) The carriage carries dual nozzles, each of which is connected to a supply of high pressure water via a heavy duty hose. In one embodiment of the present invention, each nozzle receives water via a manifold having a single outlet and plural inlets, with each outlet supplying a nozzle. Each inlet is connected to a high pressure pump fluidly connected to a water source. If only one nozzle is being used, water flow to the other nozzle may be shut off by shutting of the high pressure pumps associated therewith.

(6) Preferably, the nozzles are rotated using a hydraulic motor. In one embodiment, the hydraulic motor rotates a drive sprocket coupled to a driven sprocket on each drive shaft for each particular nozzle via a common flexible drive belt or timing belt. A coupling is provided within the flow circuit from the source of water to the nozzle allowing a conduit adjacent the nozzle to rotate with respect to a conduit receiving water from the source thereof, so that each nozzle can be rotated without any water leakage.

As such, it is a first object of the present invention to provide a dual nozzle hydro-demolition system.

It is a further object of the present invention to provide such a system in which a mobile robot is used to position the device for pulverization of concrete.

It is a still further object of the present invention to provide such a device in which an elevated boom is affixed to the mobile robot to allow elevation of the nozzles to a desired elevation for pulverization of concrete off the ground.

It is a yet further object of the present invention to provide such a system in which a plurality of nozzles are supplied with high pressure water and are rotated at a desired rate of rotation.

It is a yet further object of the present invention to provide such a device in which a shroud protects the operator from the high pressure water and debris formed during demolition.

It is a still further object of the present invention to provide such a device with a wall attachment bracket allowing attachment to a wall surface that is being demolished.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Reference is first made to FIGS. 1–4 so that an overview of the structure of the present invention will be best understood.

Figure 1:
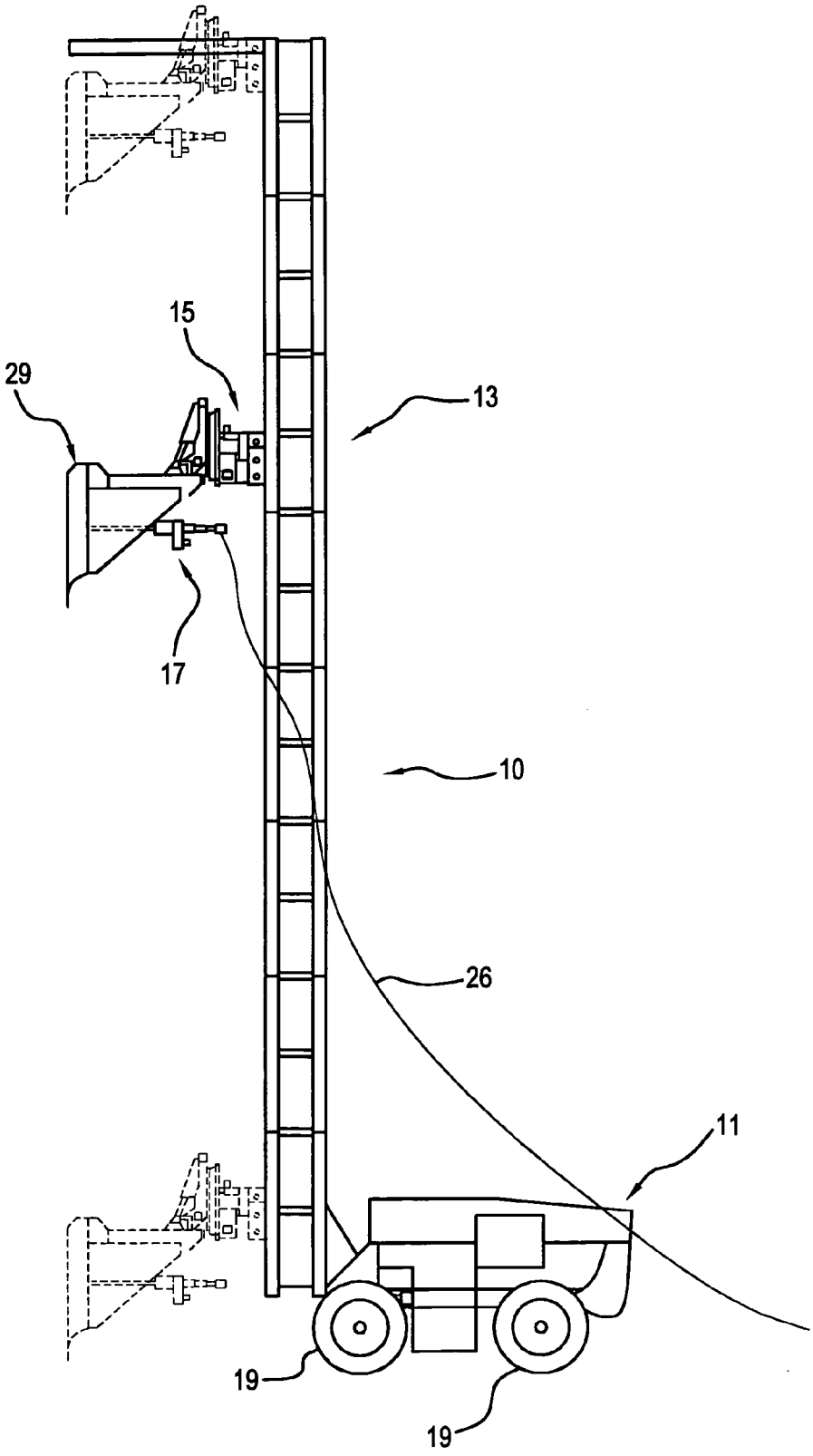
FIG. 1 shows a side elevation view of the preferred embodiment of the present invention.

With reference to FIG. 1, the present invention is generally designated by the reference numeral 10 and is seen to include a robot vehicle 11, a boom 13, a carriage 15, and cutting nozzle assembly 17 (shown in a stored position). The robot vehicle 11 includes a plurality of tires 19 allowing the vehicle 11 to be moved to any desired location. The carriage 15 is mounted to the boom 13 using a frame in a manner not shown in detail but permitting the carriage 15 to be reciprocated to any desired vertical position along the boom 13. A second alternative position for the carriage 15 is seen in phantom at the top of FIG. 1.

If desired, the robot vehicle 11 may be motorized or, if desired, may just be provided with structure allowing it to be towed and pushed to a desired location. High pressure hoses, such as the hose 26, supply water to the cutting nozzle assembly 17.

A shroud 29 extends in front of the nozzle assembly 17 to protect the operator from the water and debris mixture created through operation of the present invention. Slots (not shown) in the shroud 29 allow the nozzles to protrude slightly therethrough so that high pressure water can impinge on the wall that is being demolished without interference from the shroud 29.

Figure 2:
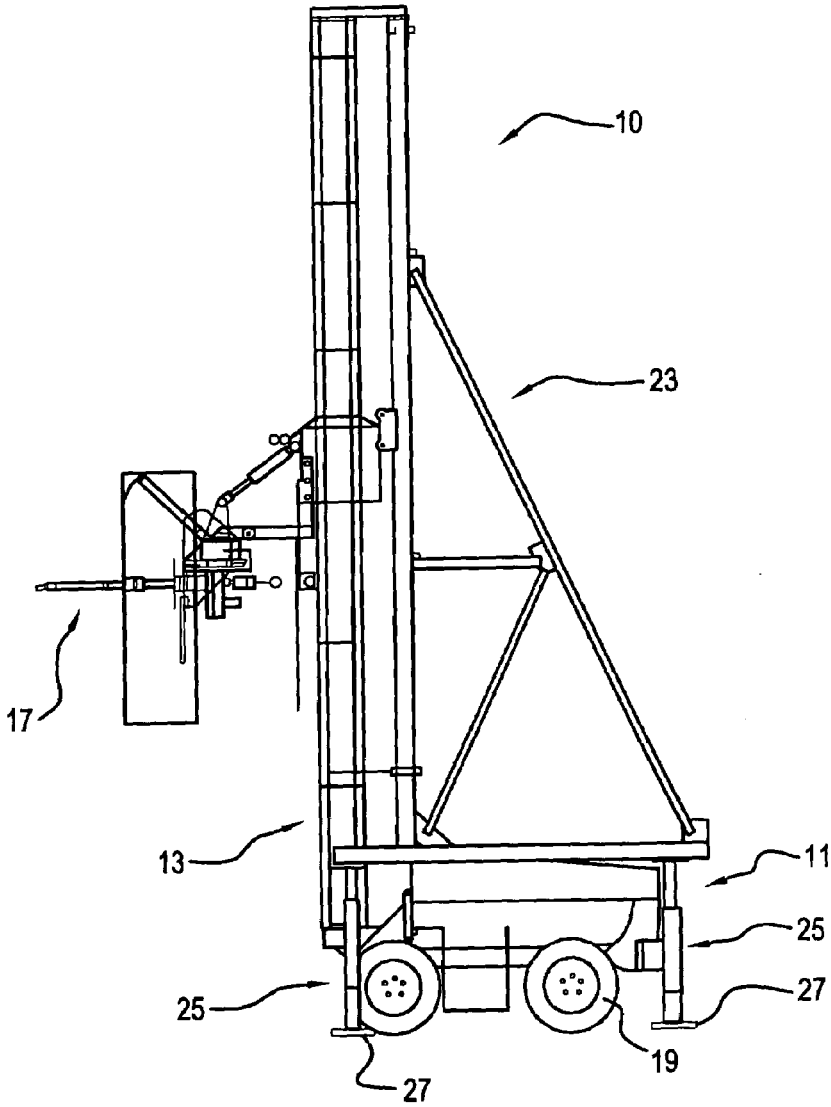
FIG. 2 shows a further side elevation view showing additional details not shown in FIG. 1.

With reference to FIG. 2, a bracing structure 23,may be provided interposed between the boom 13 and the robot vehicle 11 permitting bracing of the boom 13 which is necessary given the physical weight of the carriage 15 and cutting nozzle assembly 17 along with the weight of the water conveyed thereto. In FIG. 2, the nozzle assembly 17 is shown extended in the operating position.

Figure 3:
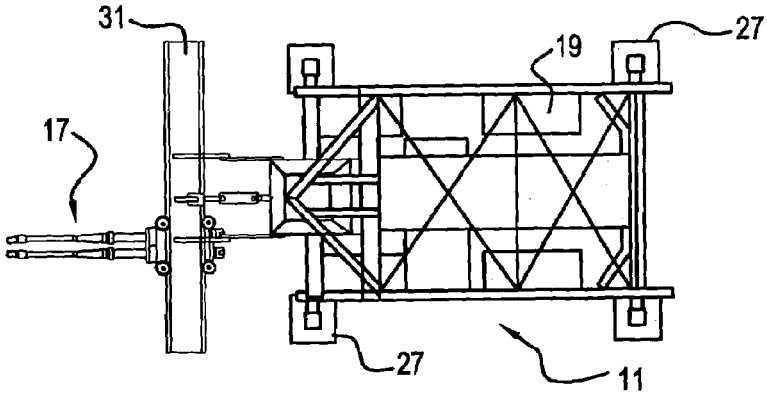
FIG. 3 shows a top view of the device illustrated in FIG. 2.

The robot vehicle 11 may also include a plurality of jacks 25, each having a ground engaging pad 27, as best seen in FIG. 3, to permit the robot vehicle 11, tires 19, to be lifted off the ground to preclude movements of the robot vehicle 11 during pulverization operations.

Figure 4:
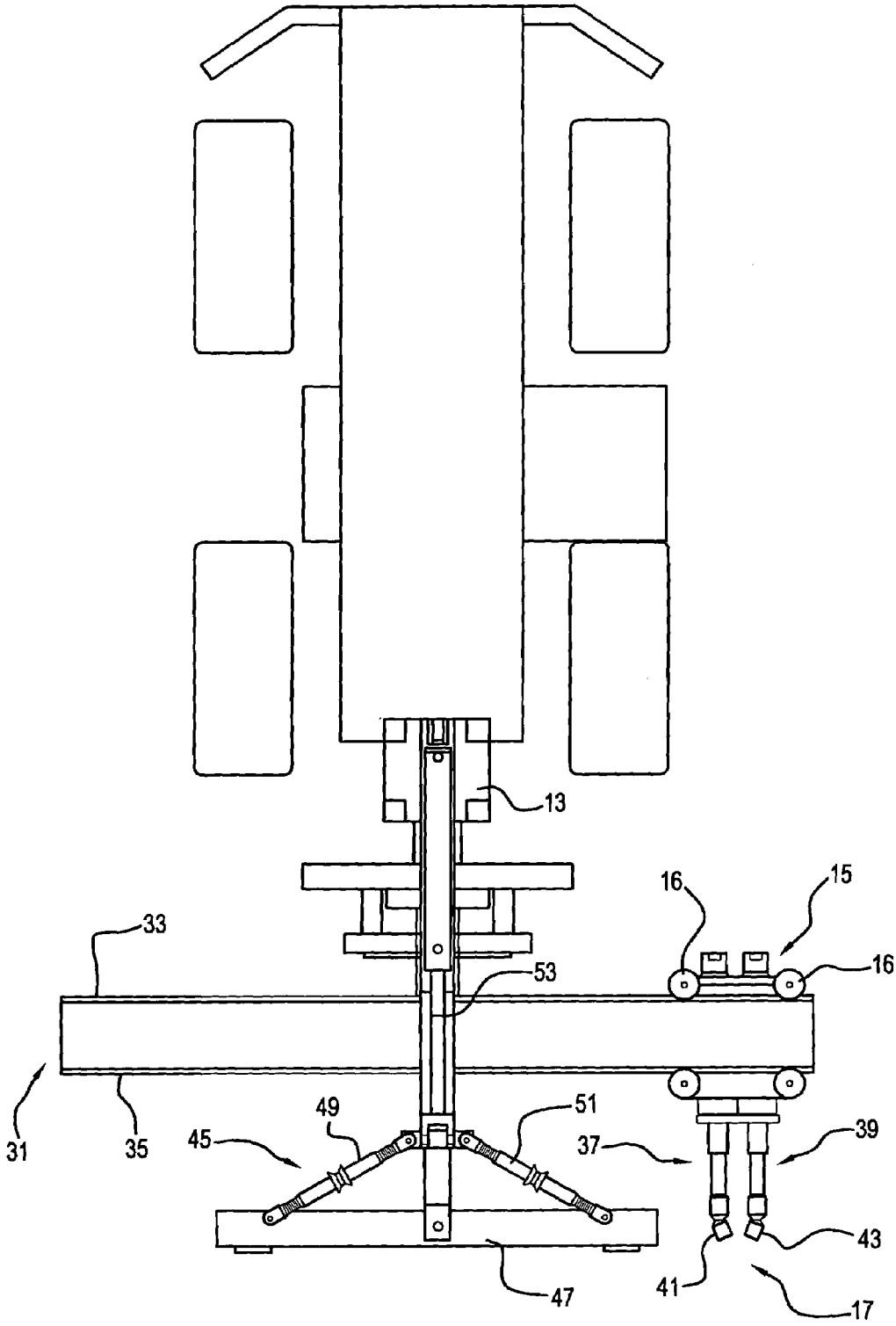
FIG. 4 shows an enlarged top view showing details of the carriage, beam, and wall attachment bracket of the present invention.
Figure 9:
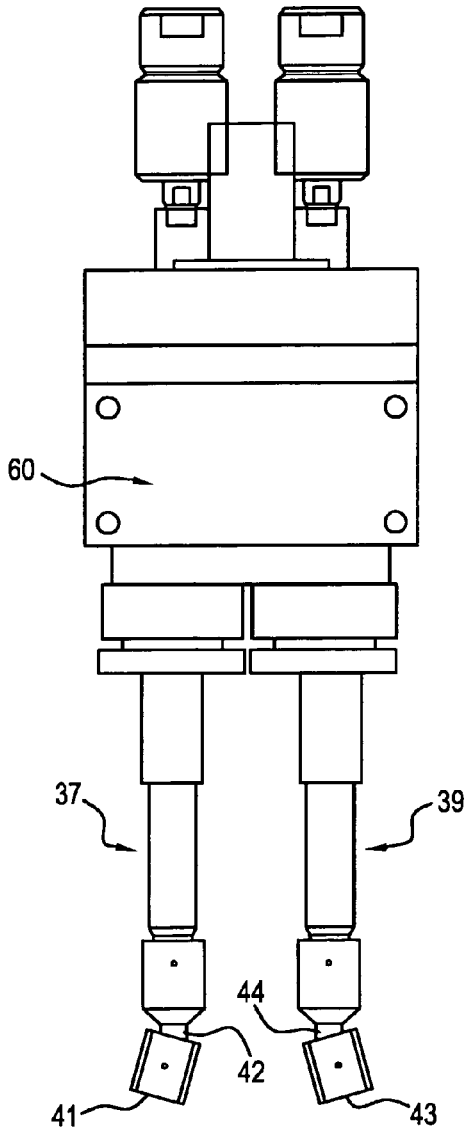
FIG. 9 shows an enlarged top view of the nozzles and drive system therefor.

With reference to FIG. 4, the carriage 15 is seen to ride on an elongated beam 31 having upper and lower vertical surfaces 33 and 35, respectively, on which ride the wheels 16 of the carriage. The nozzle assembly 17 consist of individual nozzle members 37 and 39 having respective outlets 41 and 43 shown aiming toward one another. The angular relationship between each nozzle termination 41 and 43 and the carriage 15 may be adjusted in a manner well known to those skilled in the art by virtue of ball and socket couplings 42 and 44 (see FIG. 9).

With further reference to FIG. 4, it is seen that a wall attachment bracket 45 may be provided, including the bracket 47 attachable to a wall using any desired means, and braces 49 and 51 that may include turnbuckles allowing tightening of the braces with respect to a tube 53 that connects the bracket 45 to the boom 13.

With reference, now, to FIGS. 5–10, certain aspects of the operation of the present invention will now be explained.

Figure 6:
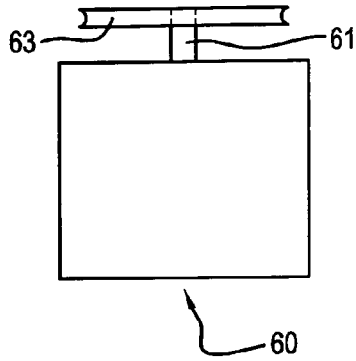
FIG. 6 shows a top view of a drive motor and pulleys for rotating the nozzles of the present invention.
Figure 7:
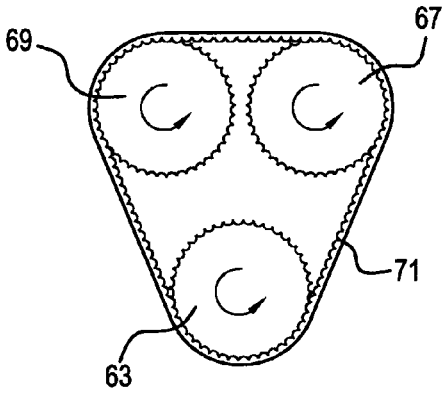
FIG. 7 shows a front view of the relationship of pulleys and belts between the motor and nozzles.

FIG. 6 shows a schematic representation of a hydraulic motor 60 used to drive rotation of the nozzles 37 and 39. The hydraulic motor 60 includes a drive shaft 61 that carries drive sprocket 63. In FIG. 7, the drive sprocket 63 is shown and driven sprockets 67 and 69 are also shown, with the sprocket 67 being coupled to the nozzle 37 and with the sprocket 69 coupled to the nozzle 39. A timing belt 71 couples the sprockets 67 and 69 to the sprocket 63. As should be understood from FIGS. 6 and 7, when the drive shaft 61 rotates, the sprocket 63 rotates therewith, thereby simultaneously rotating the sprockets 67 and 69 along with the nozzles 37 and 39.

Figure 5:
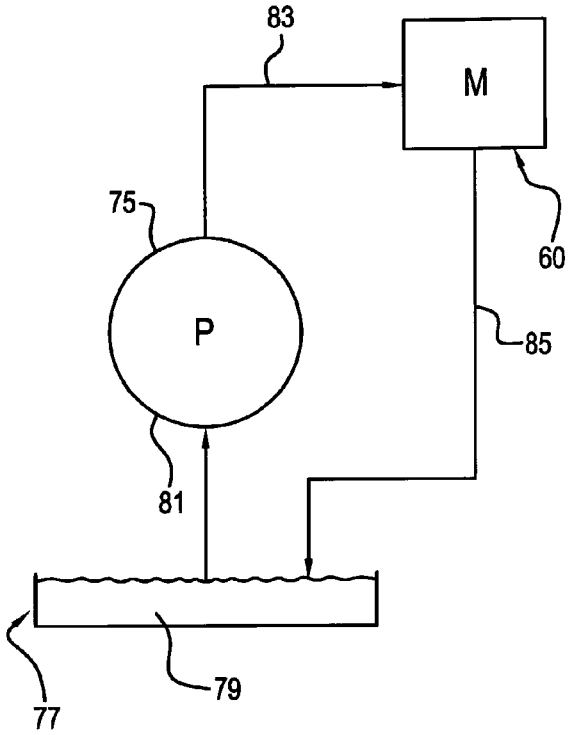
FIG. 5 shows a schematic representation of a preferred hydraulic circuit for rotating the nozzles.

With reference to FIG. 5, the operation of the hydraulic motor 60 which rotates the motor 60 should be understood. The pump 75 is unidirectional and is electrically operated. The sump 77 contains a supply of hydraulic fluid 79. In the direction of rotation of the pump, the conduit 81 conveys hydraulic fluid 79 to the pump 75, to the conduit 83, through the motor 60 to rotate the motor, and thence via the conduit 85 back to the sump 77, thereby rotating the motor, the shaft 61, the sprocket 63, the sprockets 67 and 69 through interaction with the belt 71 and, finally, the nozzles 37 and 39.

Figure 8:
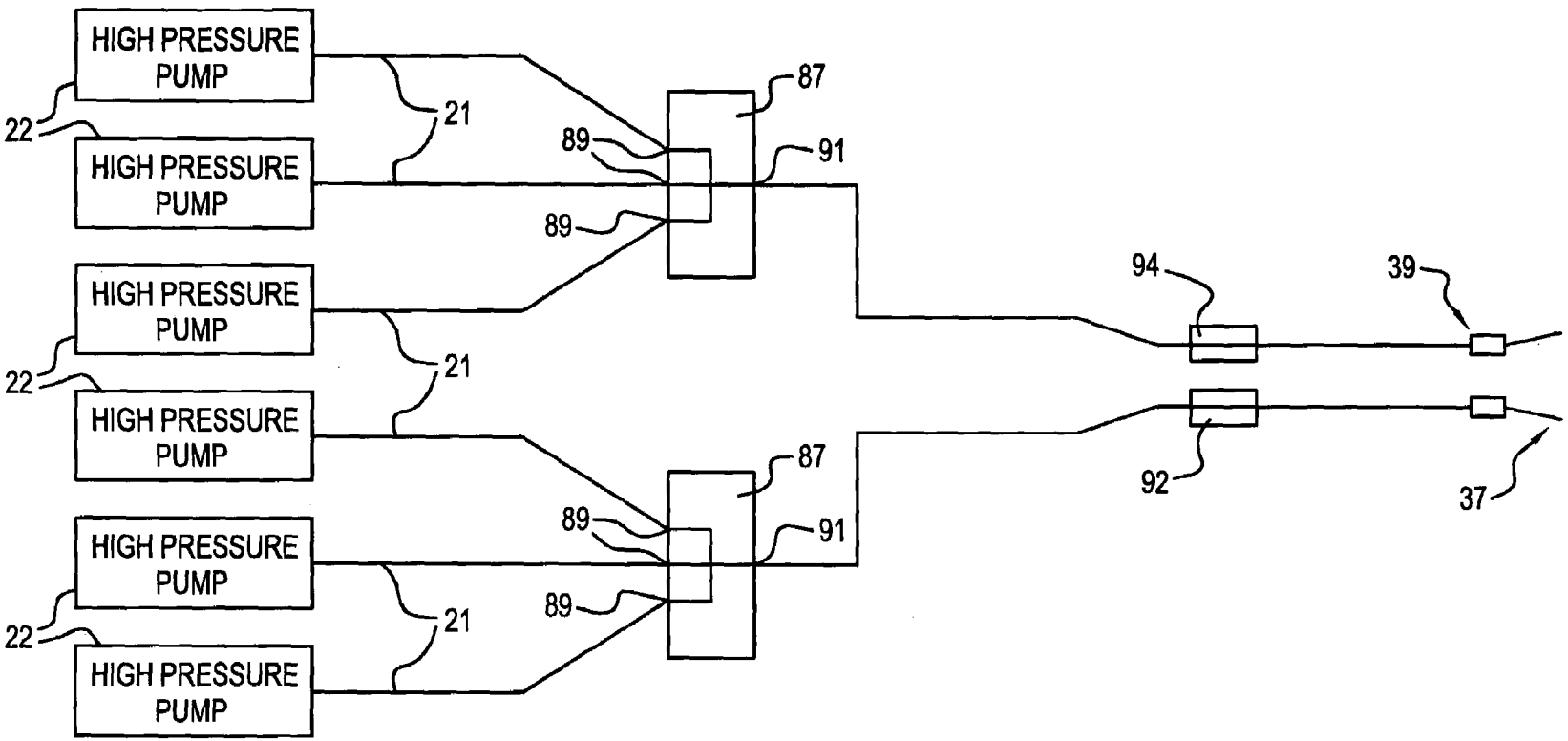
FIG. 8 shows a schematic representation of the water circuit for the nozzles of the present invention.

With reference to FIG. 8, the conduits 21 supply water from high pressure pumps 22 to manifolds 87 having three inlets 89 and one outlet 91. Each outlet 91 couples to one of the nozzles 37 or 39 via swivel couplings 92 and 94 that permit rotation of the nozzles 37 and 39 with respect to the manifold 87 while precluding leakage of water therefrom. The user may, shut off one of the nozzles by shutting off its supply pumps 22 and operate the other nozzle by supplying water to it.

In the preferred embodiment of the present invention, water may be provided at a rate of in the range of 27 gallons per minute at a pressure of in the range of 20,000 psi. The nozzles 37 and 39 may be rotated at a rotative speed at between 75 and 300 rpms.

In the operation of the present invention, the robot vehicle is conveyed to a desired location and, if desired, the wall attachment bracket 47 may be used to support the top of the boom 13 at a desired location on a wall surface. The conduit 21 is connected to a source of water supply and the belt 71 is coupled between the pulleys as seen in FIGS. 6 and 7. The pump 75 is activated to facilitate rotation of the nozzles 37 and 39 and water flow is activated so that the nozzle ends 41 and 43 spray high pressure water on the wall surface (not shown) that is to be pulverized. Applicant has found that the use of two nozzles greatly enhances the efficiency of the present invention as compared to relatively inefficient prior art systems. In particular, when a single nozzle is employed, Applicant has found that the nozzle must be conveyed back and forth across a wall a number of times to pulverize it. The number of passes necessary to pulverize a wall is greatly reduced when two nozzles, side-by-side, are employed. The dual nozzles cause a greater volume of water to impinge on each region of the wall during any given period of time, thereby speeding up pulverization.

With the robot vehicle 11 appropriately located and the boom 13 appropriately positioned, the carriage 15 is raised on the boom 13 to a desired elevation and, as explained above, the pump 75 is activated and water pressure is supplied to the nozzles 37 and 39. The carriage 15 is reciprocated back and forth along the beam 31 back and forth until the region that is being treated has been pulverized.

Figure 10:
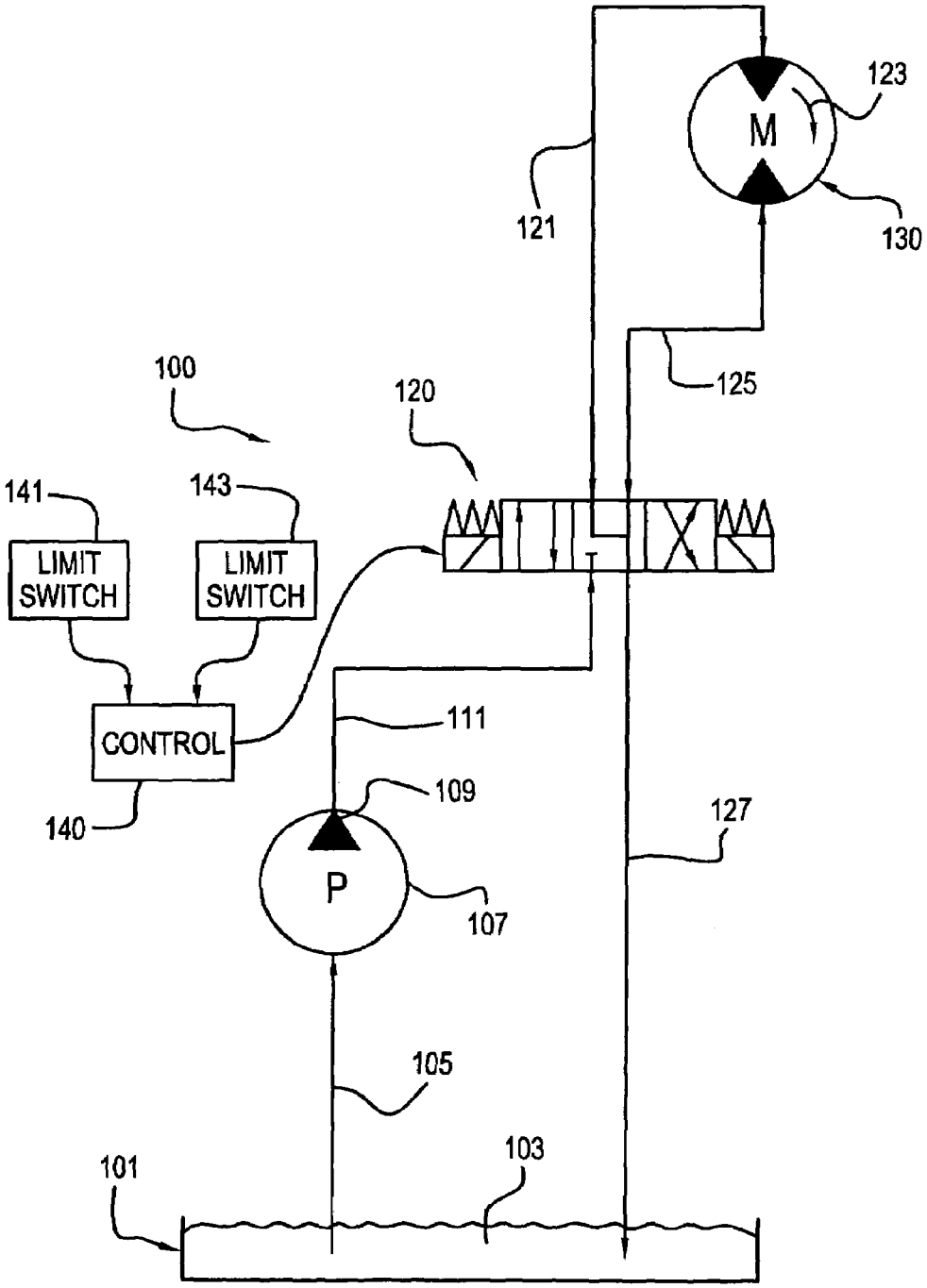
FIG. 10 shows a schematic representation of the hydraulic drive system for the carriage.

With reference to FIG. 10, a hydraulic circuit 100 is provided to reciprocate the carriage 15 back and forth. The circuit 100 includes a sump 101 filled with hydraulic fluid 103. A conduit 105 connects between the fluid 103 and the pump 107. The pump is activated in any known manner and is unidirectional. The outlet 109 of the pump 107 supplies hydraulic fluid under pressure to the conduit 111 which supplies four port reversing valve 120. A motor 130 receives hydraulic fluid from the four port reversing valve 120. In one position of the valve 120, hydraulic fluid travels toward the motor through the conduit 121 rotating the motor in the direction of the arrow 123 with hydraulic fluid exiting the motor 130 via the conduit 125, with the fluid traveling through the valve 120, into the conduit 127 and thence back to the sump 101. When the valve 120 is moved to its second position, hydraulic fluid in the conduit 111 is supplied to the conduit 125 through the valve 120, travels through the motor 130 to rotate the motor in a direction opposite to the direction indicated by the arrow 123, exits the motor 130 via the conduit 121, travels through the valve 120 to the conduit 127 and thence back to the sump 101. With this structure, the useful life of the pump 107 is considerably enhanced because the pump is only caused to move in a single direction and its operation is continuous rather than intermittent.

With further reference to FIG. 10, a control 140 causes the switching of the valve 120 back and forth. Limit switches 141 and 143 are mounted on opposite ends of the beam 15. The positions of the limit switches 141 and 143 may be suitably adjusted along the length of the beam 31 in a manner well known to those skilled in the art. Thus, when the carriage 15 travels along the beam 31 eventually it will engage one of the limit switches which will close, sending a signal to the control 140 which causes the valve 120 to move to its alternate position, thereby reversing the direction of rotation of the motor 130 and accordingly reversing the direction of movement of the carriage 15. When the carriage 15 travels to the other end of the beam 31 and strikes the other limit switch, a signal is provided to the control 140 which again moves the valve 120 to its first-mentioned position, thereby, again, reversing the direction of movement of the motor 130 and the carriage 15.

Thereafter, the carriage 15 is raised or lowered with respect to the boom 13 and the operation is repeated until a swath of wall to the height of the boom 13 and to the width of the beam 31 or any desired lesser width has been pulverized. At that point, the bracket 45 is released and the robot vehicle 11 is moved to a new location where the process is repeated.

In this way, in a highly efficient fashion, an eptire wall may quickly be pulverized so that a construction process may be continued at the location of the pulverized wall.

As such, an invention has been disclosed in terms of a preferred embodiment thereof, which fulfills each and every one of the objects of the invention as set forth hereinabove, and provides a new and useful dual nozzle hydro demolition system of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A hydro-demolition system comprising:

a) a carriage reciprocably mounted for horizontal movement on a beam carried on a vertically extending boom, an elevation of said beam being linearly adjustable along said boom;

b) a pair of fluid nozzles mounted on said carriage, each of said nozzles being connected to a plurality of sources of pressurized fluid, said nozzles being spaced apart substantially parallel to a direction of elongation of said beam, a manifold for each nozzle including a plurality of inlets and a single outlet, a separate conduit connected between each said single outlet of each manifold and a respective one of said nozzles, each inlet of each manifold being connected to a separate source of pressurized fluid;

c) means for rotating each nozzle with respect to said carriage;

d) means for adjusting elevation of said carriage with respect to a ground surface;

e) said boom mounted on a robot vehicle supported on a plurality of wheels including two forward wheels, said boom extending forward of said forward wheels and said carriage extending forward of said boom; f) said boom including a bracket above said beam for attaching an upper region of said boom to an adjacent wall surface.

2. The system of claim 1, wherein each of said nozzles includes an elongated conduit having a swivel whereby said nozzles may rotate with respect to said carriage.

3. The system of claim 1, wherein said robot vehicle has a plurality of pads mounted on respective jacks.

4. The system of claim 3, wherein said robot vehicle has four tires, said jacks, when activated, lifting said tires off a ground surface.

5. The system of claim 2, wherein each nozzle includes an outlet tip at the end of each elongated conduit, each elongated conduit having an axis of elongation, each outlet tip being angled with respect to its respective elongated conduit.

6. A hydro-demolition system comprising:

a) a robot vehicle with a vertically extending boom extending forward of said vehicle;

b) a horizontal beam carried on said boom and vertically adjustable along said boom;

c) a carriage mounted on said beam and movable along said beam from one end to another end thereof;

d) a pair of fluid nozzles mounted on said carriage, each of said nozzles being connected to a plurality of sources of pressurized fluid, said nozzles being spaced apart substantially parallel to a direction of elongation of said beam, a manifold for each nozzle including a plurality of inlets and a single outlet, a separate conduit connected between each said single outlet of each manifold and a respective one of said nozzles, each inlet of each manifold being connected to a separate source of pressurized fluid; and e) means for rotating each nozzle with respect to said carriage;

f) said boom including a bracket above said beam for attaching an upper region of said boom to an adjacent wall surface.

7. The system of claim 6, wherein each of said nozzles includes an elongated conduit having a swivel whereby said nozzles may rotate with respect to said carriage.

8. The system of claim 6, wherein said robot vehicle has a plurality of pads mounted on respective jacks.

9. The system of claim 8, wherein said robot vehicle has four tires, said jacks, when activated, lifting said tires off a ground surface.

* * * * *